US007913830B2

(12) United States Patent
Lee et al.

(10) Patent No.: US 7,913,830 B2
(45) Date of Patent: Mar. 29, 2011

(54) BILL STORAGE DEVICE IN AUTOMATED TELLER MACHINE AND METHOD FOR STORING BILL IN THE SAME

(75) Inventors: Woo Ho Lee, Seoul (KR); Jae Hoon Kwak, Anyang-si (KR); Jin Yong Hwang, Seoul (KR); Hee Chang Lee, Suwon-si (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 12/555,615

(22) Filed: Sep. 8, 2009

(65) Prior Publication Data

US 2010/0059417 A1 Mar. 11, 2010

(30) Foreign Application Priority Data

Sep. 9, 2008 (KR) ..... 10-2008-0088870

(51) Int. Cl.
*G07F 7/04* (2006.01)

(52) U.S. Cl. ..... 194/206; 414/788; 414/789; 271/177; 271/180; 271/181; 271/279

(58) Field of Classification Search ..... 414/788, 414/789, 790, 792.7; 271/180, 187, 315, 271/279, 280, 177, 178, 181; 194/206, 207; 209/534

See application file for complete search history.

(56) References Cited

U.S. PATENT DOCUMENTS 7,650,980 B2 * 1/2010 Jenrick et al. ..... 194/206

* cited by examiner

*Primary Examiner* — Jeffrey A Shapiro
(74) *Attorney, Agent, or Firm* — Fenwick & West LLP

(57) ABSTRACT

The bill storage device in an automated teller machine includes an input port through which a bill introduced in the automated teller machine is inputted perpendicularly; a pair of opening/closing plates for supporting both side surfaces of the bill inputted into the input port; first and second storage parts arranged at both sides of the input port; a push bar placed in the input port and stroke-operated selectively toward the storage part in which the bill is inputting; a push bar driving motor for performing a stroke-operation of the push bar; and a pair of push plates forcing a pressure toward the input port to support perpendicularly the bill stored by a stroke-operation of the push bar.

7 Claims, 7 Drawing Sheets

BILL STORAGE DEVICE IN AUTOMATED TELLER MACHINE AND METHOD FOR STORING BILL IN THE SAME

CROSS-REFERENCE(S) TO RELATED APPLICATION(S)

The application claims priority under 35 U.S.C. §119(a) to Korean Patent Application No. 10-2008-0088870, filed on Sep. 9, 2008, which is incorporated by reference herein in its entirety.

FIELD OF THE INVENTION

The present invention relates to a storage device and method for storing bills such as paper moneys or checks and the like received into an automated teller machine, and more particularly, to a bill storage device in an automated teller machine being capable of storing perpendicularly a paper money or a check in a state where the bill or check can be sorted and stored in a right side and left side according to a kind and a dimension of the paper money or a check, and a method for storing a bill.

BACKGROUND OF THE INVENTION

In general, a cash dispenser unit (CDU) and a bill recycling machine (BRM) have been developed for rendering rapidly and conveniently almost financial services except a consulting service without regard to time, these cash dispenser unit and bill recycling machine are referred to as an automated teller machine (ATM).

In addition to a function of receiving/drawing cash, various functions such as a unit for processing a card, an unit for processing a bankbook and a device for receiving a check are added to the ATM according to a function of financial service. In general, in a conventional storage device in the ATM, the bills or checks inputted into the ATM are stored horizontally in a storage box regardless of a kind of bill or check.

However, the conventional storage device in which the inputted bills are stored horizontally has a problem in that a size of the ATM must become large.

In view of a management of the ATM, in addition, it is necessary to sort the bills and checks and store them in the separate parts according to a kind and a size. In the conventional storage device, however, the bill and check cannot be sorted and stored separately, and so a management of the ATM is limited.

SUMMARY OF THE INVENTION

Therefore, it is an object of the present invention to provide a device and method for storing a bill being capable of achieving a compact automated teller machine.

Another object of the present invention is to provide a device and method for storing a bill in an automated teller machine, capable of sorting and storing separately a bill or a check according to a kind of the bill or the check.

In accordance with an aspect of the present invention, there is provided a bill storage device in an automated teller machine. The bill storage device includes a pair of opening/closing plates for supporting both side surfaces of the bill inputted into the input port; first and second storage parts arranged at both sides of the input port for storing the bill; a push bar placed in the input port and stroke-operated selectively toward a target storage part in which the bill is inputting; a push bar transferring module for performing a stroke-operation of the push bar; and a pair of push plates forcing a pressure toward the input port to support perpendicularly the bill stored the target storage part by a stroke-operation of the push bar.

The push bar transferring module includes a sliding member coupled to a lower portion of the push bar and a driving motor for enabling the sliding member to be slid, and it is preferable that the bill storage device further includes a link module being interlocked with a stroke-operation of the push bar to retreat any one of the opening/closing plates.

The link module includes a pair of first rotating members being rotated individually according to a sliding of the sliding member; a pair of second rotating members being rotated according to rotations of the first rotating members, respectively, to allow the opening/closing plate to be coupled to the second rotating members to retreat the opening/closing plate; and a pair of springs supplying a pressure to each of the second rotating members to allow the opening/closing plates to be placed in a closing state.

In accordance with another aspect of the present invention, there is provided a method for storing bill in a bill storage device in the automated teller machine. The method includes determining a target storage part for storing the bill according to a kind and a dimension of the bill to be inputted; placing a push bar at an adjusted location in advance before the bill is inputted for allowing the push bar to push the bill toward the target storage part; inputting perpendicularly the bill toward the target storage part through an input port; and stroke-operating the push bar toward the target storage part to store perpendicularly the bill, which is inputted through the target input port, into the target storage part.

BRIEF DESCRIPTION OF THE DRAWINGS

The above and other objects and features of the present invention will become apparent from the following description of embodiments given in conjunction with the accompanying drawings, in which.

DETAILED DESCRIPTION OF THE EMBODIMENTS

Hereinafter, embodiments of the present invention will be described in detail with reference to the accompanying drawings so that they can be readily implemented by those skilled in the art.

Figure 1:
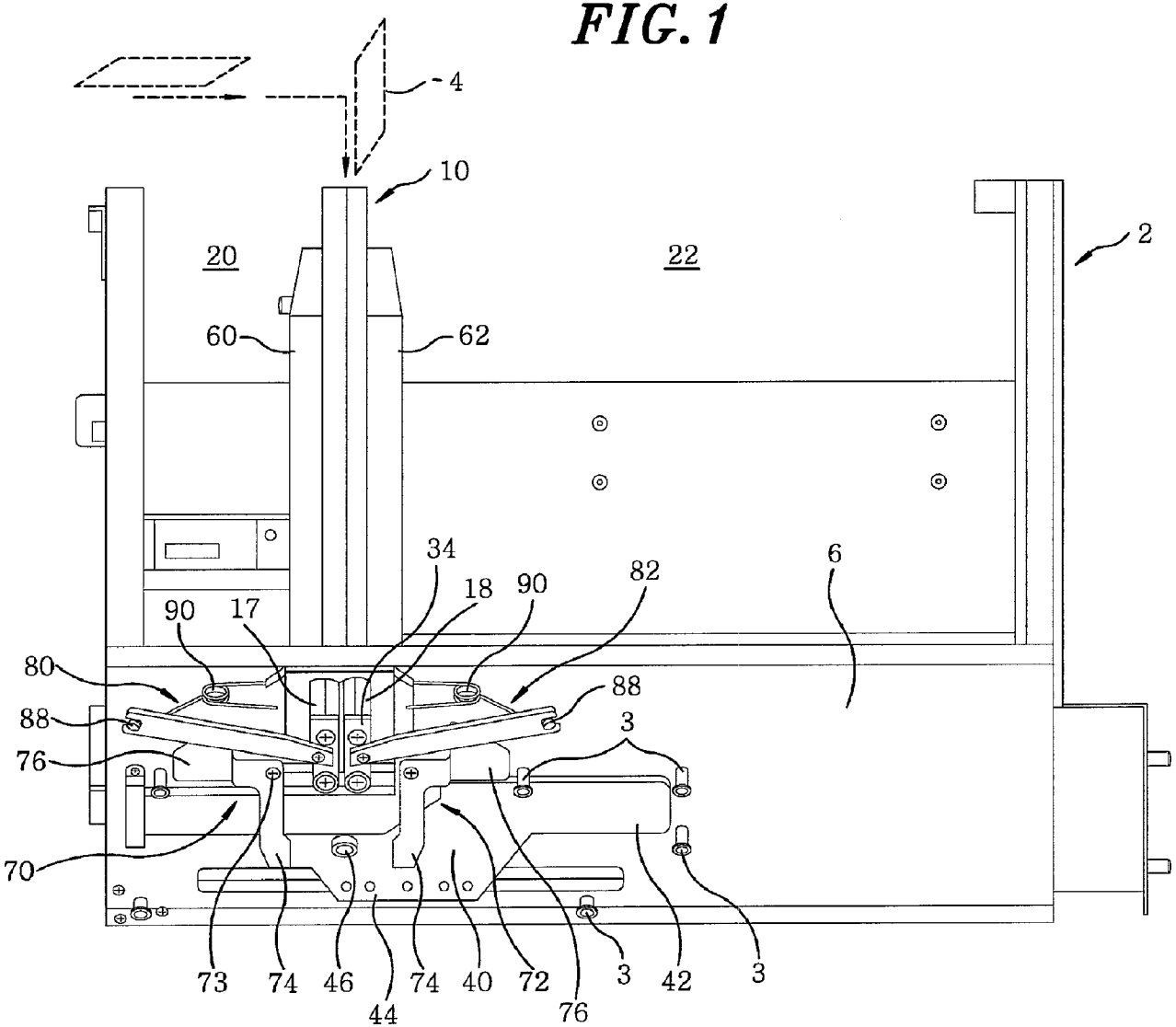
FIG. 1 is a schematic bottom perspective view of a bill storage device in an automated teller machine in accordance with an embodiment of the present invention, which is in a standby mode.
Figure 2:
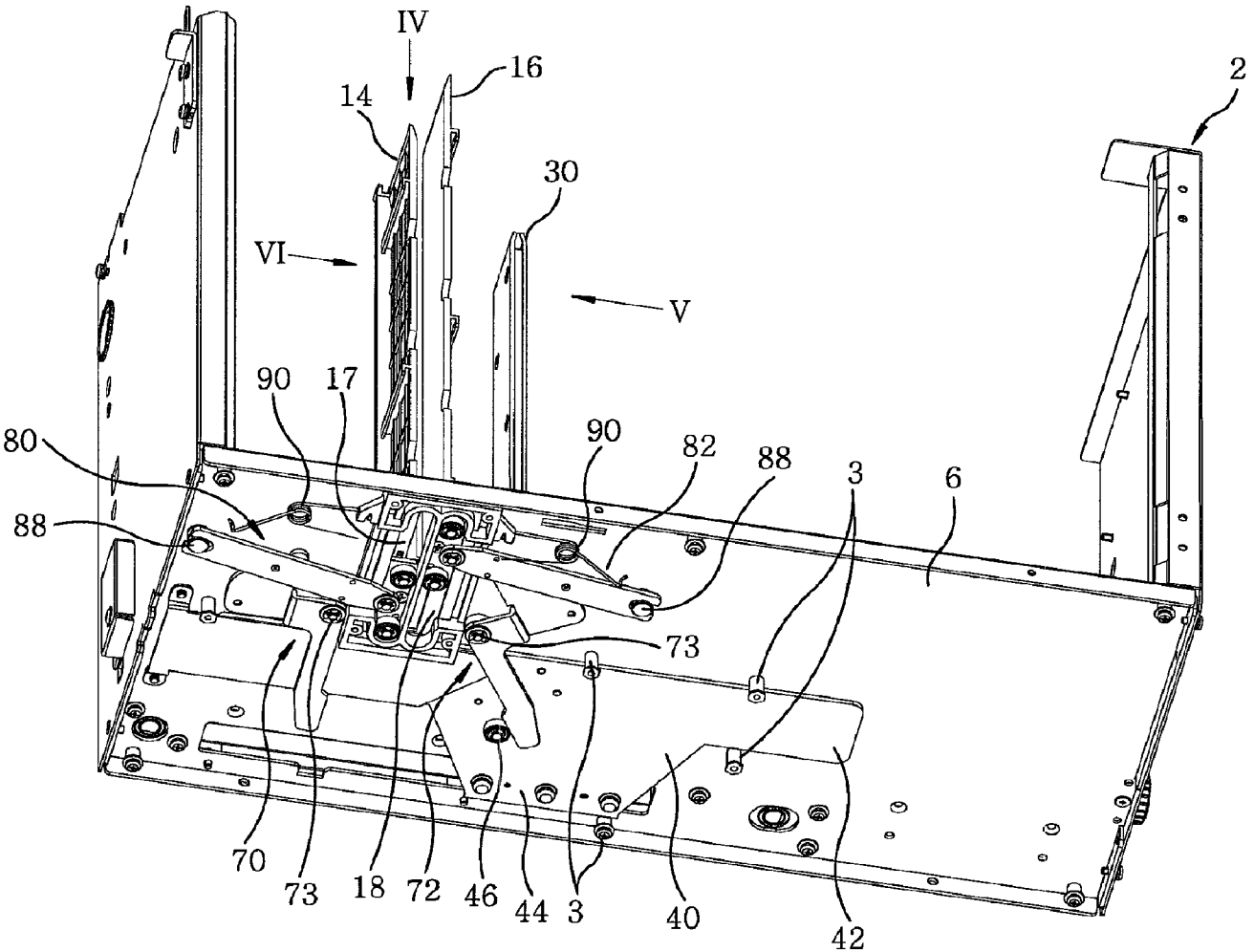
FIG. 2 is a schematic bottom perspective view of the bill storage device shown in FIG. 1 in a receiving mode, which illustrates one side opening/closing plate in an input port.
Figure 3:
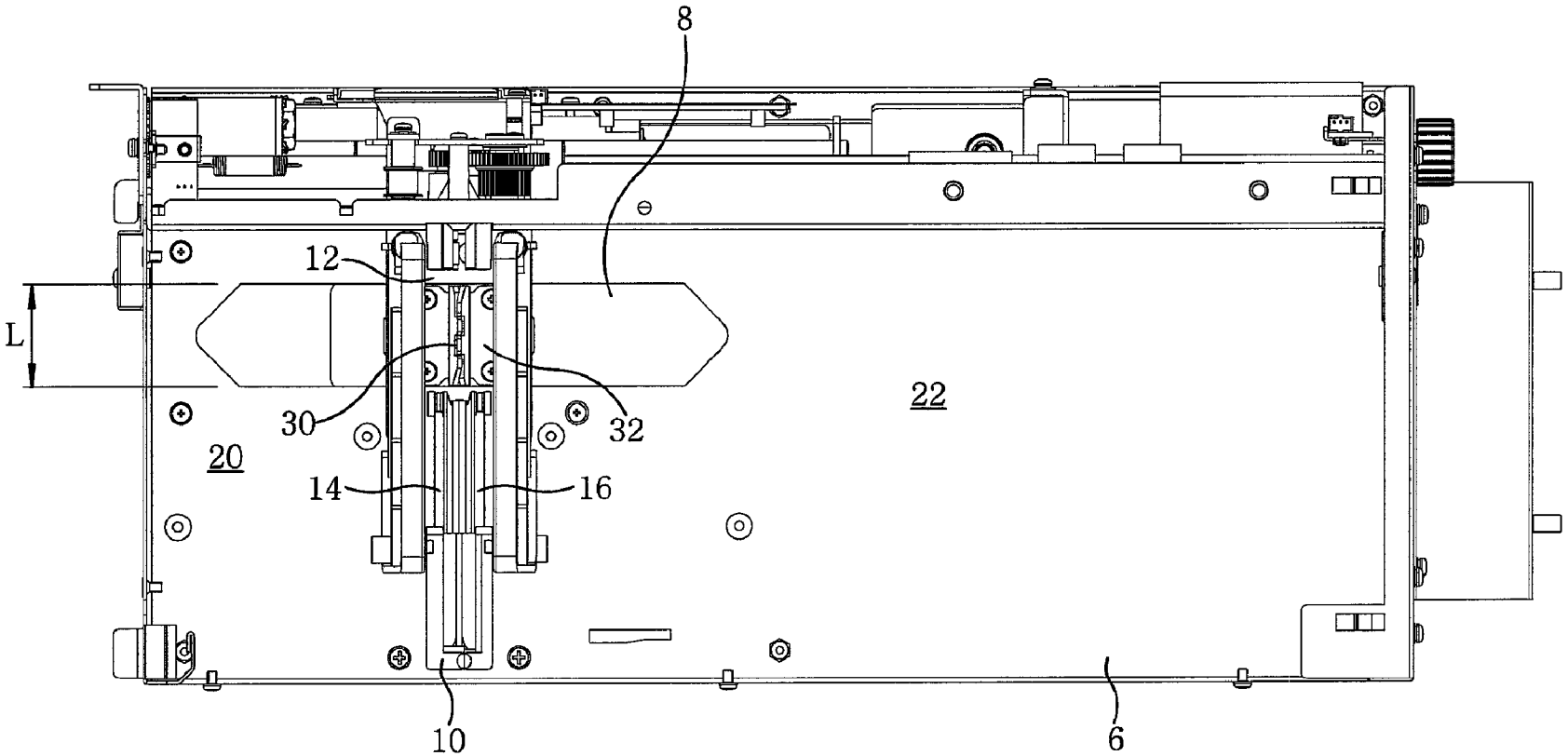
FIG. 3 is a plane view of a bill storage device shown FIG. 1.

FIG. 1 is a schematic bottom perspective view of a bill storage device in an automated teller machine according to one preferred embodiment of the present invention, which is in a standby mode, and FIG. 2 is a schematic bottom perspective view of a bill storage device which is in a receiving mode, for illustrating one side opening/closing plate in an input port. Here, a push plate is omitted in FIG. 2. Also, FIG. 3 is a plane view of the bill storage device shown FIG. 1.

As shown in FIG. 1 and FIG. 2, a bill storage device in an automated teller machine of the present invention comprises an input port 10 to which a bill 4 is received into the automated teller machine (hereinafter, referred to as "ATM") and then is introduced vertically; a pair of opening/closing plates 14 and 16 for supporting both side surfaces of the bill received through the input port 10; first and second storage parts 20 and 22 arranged with respect to the input port 10; a push bar 30 (see FIG. 2) located in the input port 10 such that the push bar is selectively stroke-operated toward the storage part into which the bill 4 is inputting; a push bar transferring module 40 and 50 for performing a stroke-operation of the push bar 30; and a pair of push plates 60 and 62 for applying a pressure toward the input port 10 to support vertically the bill stored by a stroke-operation of the push bar 30.

The bill storage device of the present invention comprises a main body 2 having a rectangular parallelepiped box, the input port 10 is fixedly provided in the main body 2 like a partition wall. The first and second storage parts 20 and 22 are arranged at right side and left side of the input port 10, and the bill 4 (indicated by a dotted line in FIG. 1) introduced into the ATM is conveyed horizontally and inputted vertically into the input port 10 from an upper side of the input port 10. In addition, the pair of push plates 60 and 62 placed at both sides of the input port 10 are installed such that the push plates 60 and 62 are slid toward right and left sides of the input port 10 by a stroke-operation of the push bar 30 to increase a gap in-between and then force a pressure toward the input port 10.

In general, while the bill 4 introduced into the ATM is conveyed through a path provided in the ATM, a size and kind of the bill is recognized, and so the storage parts 20 and 22 in which the bill will be stored can be determined in advance. Accordingly, if the above structure is employed to the bill storage device of the present invention in which the storage parts 20 and 22 are formed at right and left sides of the input port 10, a selective stack of the bill by which the bill introduced into the ATM can be received selectively in a target storage part determined in advance can be performed. In the drawings, although a space in the second storage part 22 at right is much larger than that of the first storage part 22 at left, it will be apparent that the spaces of the storage parts may be adjusted on the basis of an operation of the ATM.

As can be seen from FIG. 3, a guide groove 8 is formed on a bottom 6 of the main body 2, the input port 10 having an opening section 12 of a certain width L formed thereon is perpendicular to an mid portion of the guide groove 8 to allow the opening section 12 to be communicated with the guide groove 8. In addition, a flange part 32 attached to a lower portion of the push bar 30 is inserted in the guide groove 8, and the push bar 30 is located in the opening section 12 and stroke-operated from right to left to close the opening section 12 of the input port 12 in a standby state. At this time, it is preferable that the push bar 30 has a width enough to enable the push bar to be passed easily through the opening section 12 and to push easily the introduced bill 4 to the storage part.

As shown FIG. 2 and FIG. 3, a pair of opening/closing plates 14 and 16 installed in the input port 10 supports both surfaces of the side portions of the bill introduced into the input port 10. In a state where the bill is introduced into the input port 10 and supported perpendicularly by the opening/closing plates 14 and 16, when one opening/closing plate corresponding to the storage part selected to store the bill is retreated, the bill becomes a free state, that is, the bill is not supported, and so the storing operation can be performed by only a short stroke of the push bar 30. As a result, that the storage space in the ATM becomes increase accordingly.

Also, for example, in a case where the bill 4 which has a relative small size and is located at the opening section 12 of the input port 10 is stored in the second storage part 22, even though a short right stroke of the push bar 30 is determined, the push bar can push the bill in the second storage part 22 since the opening section 12 has a preset width. However, it is not easy to push the larger-sized bill into the storage part through the opening section 12 having the same width. Accordingly, in order to push easily the bill into the storage part through the opening section having the same width regardless of a size of the bill 4, a stroke of the push bar 30 should be lengthened. Due to the above solution, however, a dimension of the storage device becomes large so that it is difficult to realize and achieve the compact ATM. In the bill storage device of the present invention, therefore, although the push bar 30 is moved along the guide groove 8 with the determined short stroke, the opening/closing plates 14 and 16 are interlocked with left/right stroke of the push bar 30 and then retreated to open further the opening section 12. Therefore, it is possible to push easily the bill into the first and second storage parts 20 and 22.

The stroke operation of the push bar 30 as described above is performed by a push bar transferring module comprised of a sliding member 40 and a push bar driving motor 50 which causes the sliding member 40 to slide. In response to a stroke-operation of the push bar 30, a link module retreats any one of the opening/closing plates 14 and 16. The link module includes a pair of first rotating members 70 and 71 being rotated individually according to a sliding of the sliding member 40, a pair of second rotating members 80 and 82 being rotated according to rotations of the first rotating members 70 and 72, respectively, to allow the opening/closing plate to be coupled to the second rotating members 80 and 82 to retreat the opening/closing plate, and a pair of springs 90 forcing a pressure to each of the second rotating members 80 and 82 to allow the opening/closing plates 14 and 16 to be placed in a closing state.

Figure 4:
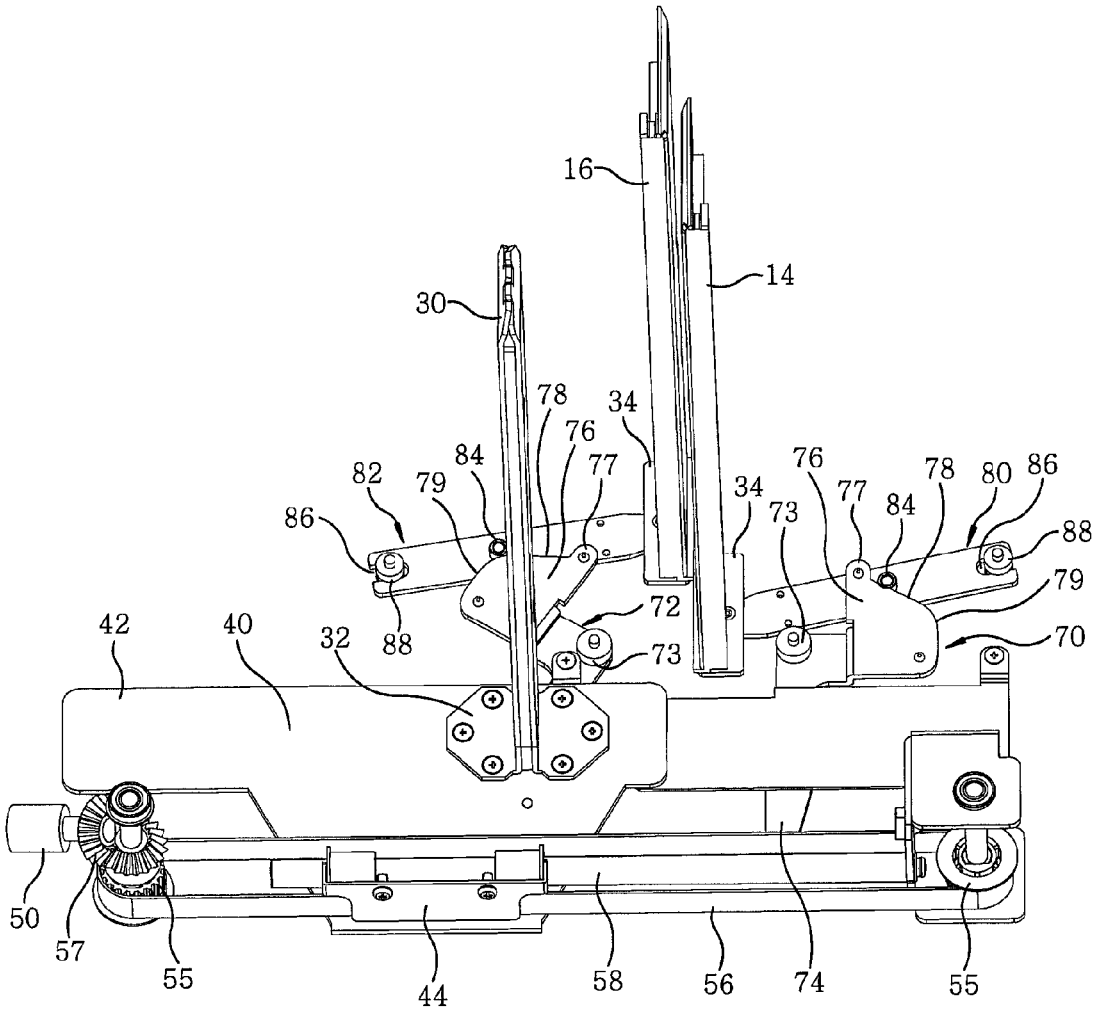
FIG. 4 is a schematic perspective view seen from "IV" in FIG. 2.
Figure 5:
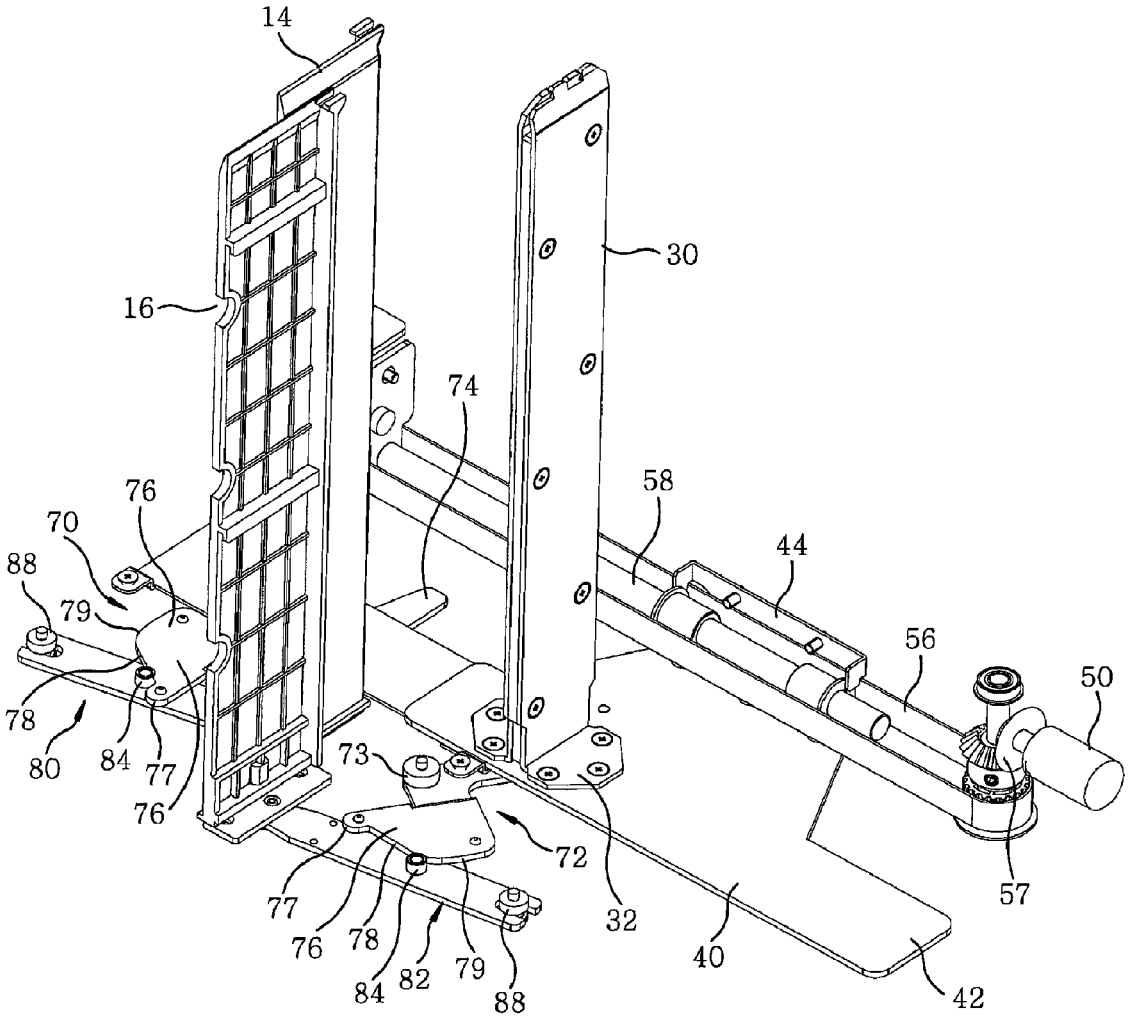
FIG. 5 is a schematic perspective view seen from "V" in FIG. 2.
Figure 6:
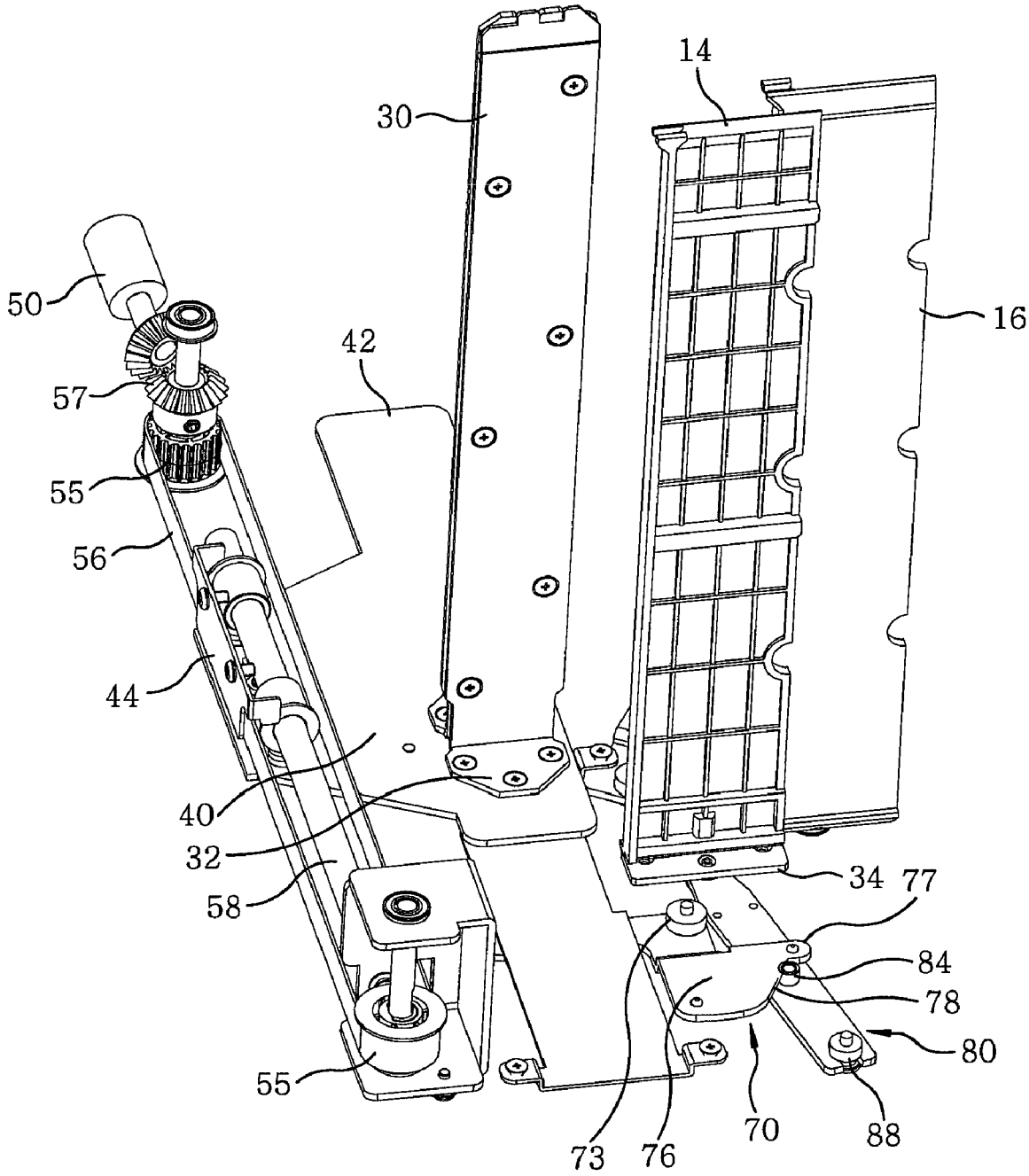
FIG. 6 is a schematic perspective view seen from "VI" in FIG. 2.

As can be seen from FIG. 4 to FIG. 6, the sliding member 40 is attached to a low side of the push bar 30 and screw-coupled to the flange part 32 inserted in the guide groove 8. A rectangular projection part 42 is formed on a front surface of the sliding member 40 and is guided by guide protrusions 3 provided in parallel on a bottom of the main body 2. In addition, a coupling part 44 formed on one side of the sliding member 40 is coupled to a driving belt 56 wound around a driving pulley 55 and inserted into a guide rod 58 so that the sliding member 40 is slid along the guide rod 58 depending on a rotation of the driving belt 56. A bevel gear 27 coupled to a shaft of the push bar driving motor 50 is provided on one side of the driving pulley 55, and so the driving belt 56 is rotated forwardly/reversely according to a forward/reverse rotation of the driving motor 50. Due to the above operation, the sliding member 40 is slid from side to side, and so the push bar 30 is stroke-operated from side to side.

Further, in the bill storage device of the present invention, a pair of guide slits 17 and 18 are formed at a lower side of the input port 10, the opening/closing plates 14 and 16 are inserted into the guide slits 17 and 18, respectively, and a coupling plate 34 is screw-coupled and attached to a lower side of the guide slits. A bearing protrusion 46 is provided at a center of the sliding member 40, and a pair of first rotating members 70 and 72 opposited to each other about the bearing protrusion 46 are provided. Each of the first rotating members 70 and 72, which has a capital letter of alphabet "L" shape, is divided into a vertical part 74 and a convexed part 76 formed on a horizontal region with respect to a first hinge shaft 73. The convexed part 76 is comprised of an inclined surface 78 extended from a protrusion 77 formed on one side thereof and a curved surface 79 connected to the inclined surface 78.

In addition, a pair of the second rotating members 80 and 82 is interlocked with the first rotating members 70 and 72, respectively, and so each of the second rotating members is rotated in response to a rotation of each first rotating member. Each of the second rotating members 80 and 82 has a rotating pin 84 protruded downward on a center thereof, and one end of each second rotating member is screw-coupled to the coupling plate 34 attached to a lower surface of each of the opening/closing plates 14 and 16. Also, each of second rotating members has a recess 86 formed on the other end thereof, a second hinge shaft 88 being inserted into the recess. In a standby state pressurized by the spring 90, the rotating pin 84 formed on a center of each of the second rotating members 80 and 82 is in contact with the protrusion 77 of the convexed part 76 of each of the first rotating members 70 and 72. In a rotating state, however, the rotating pin 84 must be moved from the inclined surface 78 to the curved surface 79 of each of the first rotating members 70 and 72 and then placed on the curved surface 79.

Figure 7:
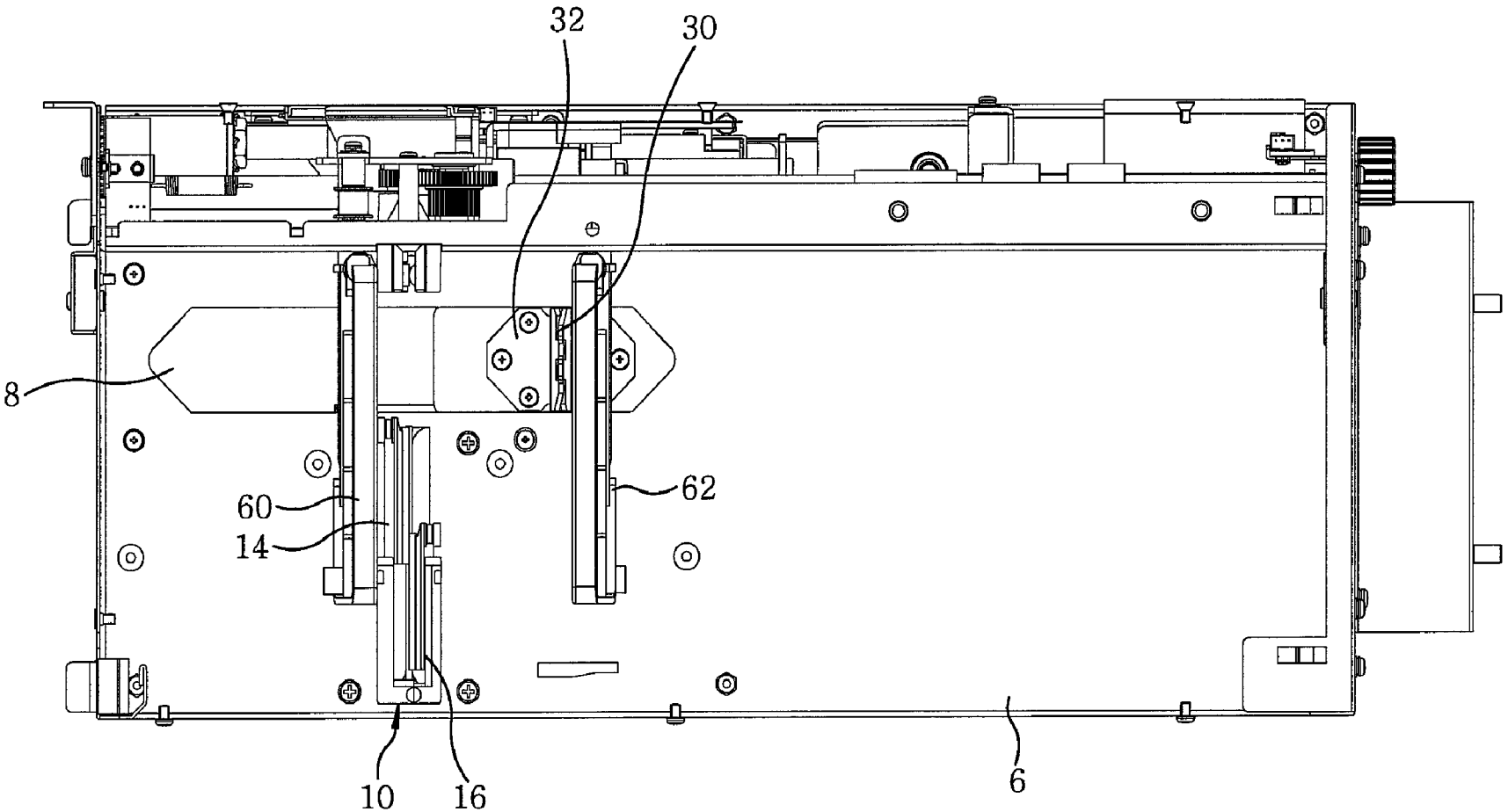
FIG. 7 is a plane view of a bill storage device shown FIG. 2.

As shown in FIG. 7, if the push bar 30 is stroke-operated toward the second storage part 22, the sliding member 40 is also slid in the right direction in FIG. 2, that is, is slid toward the second storage part 22. At this time, the bearing protrusion 46 provided on the sliding member 40 pushes the vertical part 74 of the first rotating member 72, which causes the first rotating member 72 to rotate in a counterclockwise direction with respect to the first hinge shaft 73.

On the contrary, although not shown concretely in the drawings, if the sliding member 40 is slid in the left direction, that is, is slid toward the first storage part 20, the bearing protrusion 46 provided on the sliding member 40 pushes the vertical part 74 of the first rotating member 70 as mentioned above, and therefore, the first rotating member 70 is rotated in a clockwise direction with respect to the first hinge shaft 73.

If the first rotating member 72 is rotated in a counterclockwise direction as described above, the rotating pin 84, which is formed at a center of the second rotating pin 82 and is in contact with the protrusion 77 of the convexed part 76 of the first rotating member 72, is moved from the inclined surface 78 to the curved surface 79 of the convexed part 76 of the first rotating member 72 and then placed on the curved surface, and so the second rotating member 82 is rotated in a clockwise direction with respect to the second hinge shaft 88. Simultaneously, the coupling plate 34 below the opening/closing plate 16 which is screw-coupled to one end of the second rotating member 82 is moved along the guide slit 18 of the input port 10. Accordingly, the opening/closing plate 16 is moved forward and backward in the input port 10.

Similarly, if the first rotating member 70 is rotated in a clockwise direction, the second rotating member 80 interlocked with the first rotating member 70 is rotated in a counterclockwise direction so that the opening/closing plate 14 is moved forward and backward in the input port 10.

The bill is stored in a target bill storage device of the ATM according to the present invention configured as described as follows.

If the bill is introduced into the ATM, while the bill is conveyed through a conveyance path in the ATM, a kind and dimension of the bill are recognized by an appropriate recognition scheme well-known in the art, and then, on the basis of the recognition result, one target storage part of the storage parts 20 and 22 is determined in advance to store the bill.

According to the above determination, the push bar 30 is placed at a certain location in advance where the push bar will push the bill toward the target storage part before the bill is stored in the target storage part.

Subsequently, the bill inputted through the input port 10 is conveyed perpendicularly toward the target storage part determined in advance. For example, if it is determined that the bill 4 is to be stored into the second storage part 22, the bill introduced vertically through the input port 10 is placed in the opening section 12 of the input port 10 between the push bar 30 and the second storage part 22.

Subsequently, the driving motor 50 is driven to stroke-operate the push bar 30 toward the second storage 22, and so the driving belt 56 is then rotated forwardly/reversely. According to a rotation of the driving belt, the sliding member 40 is slid toward the second storage part 22, and the bearing protrusion 46 formed on a center of the sliding member 40 pushes the vertical part 74 of the first rotating member 72. As a result, the first rotating member 72 is rotated in the counterclockwise direction with respect to the first hinge shaft 73, and the second rotating member 82 interlocked with the first rotating member 72 is rotated in the clockwise direction with respect to the second hinge shaft 88 to open the opening/closing plate 16.

In the bill storage device of the present invention as described above, in response to a stroke-operation of the push bar 30 toward the second storage part 22, the opening/closing plate 16 is retracted into the input port 10, and so the bill 4 passing through the opening section 12 of the input port 10 is pushed and received easily into the second storage part 22 by a stroke-operation of the push bar 30. Simultaneously, since the pushed bill 4 is pressurized toward the input port 10 by the push plate 62, the bill is stored perpendicularly between the input port 10 and the push plate 52.

According to the present invention, in the first and second storage parts arranged at both sides of the input port through which the bill introduced in the ATM is inputted, the bill is introduced perpendicularly toward one storage part which is selected for storing the bill according to a kind and a dimension of the inputted bill so as to allow the push bar to be stroke-operated. Accordingly, the bill can be stored selectively and perpendicularly to achieve the compact ATM, and the bill can be sorted and stored according to a kind thereof to increase a convenience of an operation of the automated teller machine.

Only the preferred embodiment of the device and method for storing the bill in the automated teller machine according to the present invention is illustrated in the above description, and the present invention is not limited to the above embodiment. For example, in the above embodiment, the push bar and the opening/closing plate can be operated by one driving source through a link means. However, the push bar and the opening/closing plate can be operated independently by the separate driving sources.

While the invention has been shown and described with respect to the preferred embodiments, it will be understood by those skilled in the art that various changes and modifications may be made without departing from the scope of the invention as defined in the following claims.

What is claimed is:

1. A bill storage device for storing a plurality of bills in an automated teller machine having a controller for determining whether a bill having four edges and two faces is of a first configuration or a second configuration, the bill storage device comprising;

a main body including a first storage part and a second storage part, the first storage part storing a first stack of bills in an upright manner with edges of the first stack of bills set on a surface of the main body, and a second storage part storing a second stack of bills in an upright manner with edges of the second stack of bills set on the surface of the main body;

an input port at one side of the main body through which a bill is fed edgewise into the main body along a path;

a first opening/closing plate within the main body, the first opening/closing plate slidably movable relative to the input port in a direction substantially perpendicular to the path, responsive to the controller determining that the bill is of the first configuration, to open a first part of the input port and place the fed bill for storing in the first storage part in a first position of the main body in an upright manner with an edge of the bill set on the surface of the main body;

a second opening/closing plate within the main body, the second opening/closing plate slidably movable relative to the input port in a direction substantially perpendicular to the path, responsive to the controller determining that the bill is of the second configuration, to open a second part of the input port and place the fed bill for storing in the second storage part in a second position of the main body in an upright manner with an edge of the bill set on the surface of the main body;

a first push plate in the first storage part for supporting a face of the first stack of the bills;

a second push plate in the second storage part for supporting a face of the second stack of the bills; and a push bar between the first push plate and the second push plate;

wherein responsive to the controller determining that the bill is of the first configuration, the push bar pushing the bill in the first position towards the first push plate and away from the second opening/closing plate in a direction substantially perpendicular to the path to store the bill in the first storage part with the bill compressed into the first stack, wherein responsive to determining at the controller that the bill is of the second configuration, the push bar pushing the bill in the second position towards the second push plate and away from the first opening/closing plate in a direction substantially perpendicular to the path to store the bill in the second storage part with the bill compressed into the second stack, and wherein responsive to storing the bill in either the first storage part or the second storage part, the push bar returns to a position between the first position and the second position.

2. The bill storage device of claim 1, further comprising a push bar transferring module for causing a motion to move the push bar towards the first push plate or the second push plate, wherein the push bar transferring module comprises a sliding member coupled to a lower portion of the push bar and a driving motor for causing a sliding motion of the sliding member.

3. The bill storage device of claim 2, further comprising a link module coupled to the push bar transferring module for moving the first or second opening/closing plate.

4. The bill storage device of claim 3, wherein the link module comprises:

a pair of first rotating members, each of the first rotating members rotatable responsive to the sliding motion of the sliding member;

a pair of second rotating members, each of the second rotating member rotatable responsive to rotation of each of the first rotating members to open the first part of the input port or to open the second part of the input port; and a pair of springs applying pressure to each of the second rotating members to return the first and second opening/closing plates to close the first part and the second part of the input port.

5. A method for storing a plurality of bills in a bill storage device of an automated teller machine, each bill having four edges and two faces, comprising the steps of;

sending a command from a controller responsive to determining at the controller of the automated teller machine whether a bill is of a first configuration or a second configuration;

responsive to receiving the command from the controller and determining that the bill is of a first configuration, slidably moving a first opening/closing plate in a horizontal direction from an initial position between a first position and a second position in a main body to open a first part of an input port;

responsive to slidably moving the first opening/closing plate, receiving the bill edgewise moving along a vertical path into the first position of the main body in an upright manner with an edge of the bill set on a surface of the main body;

responsive to receiving the command from the controller and determining that the bill is of a second configuration, slidably moving a second opening/closing plate in the horizontal direction to open a second part of the input port;

responsive to slidably moving the second opening/closing plate, receiving the bill edgewise moving along the vertical path into the second position of the main body in an upright manner with an edge of the bill set on the surface of the main body;

responsive to receiving the bill in the first position, pushing the bill by a push bar in the first position towards a first push plate away from the second opening/closing plate in a horizontal direction to store the bill in a first storage part of the main body;

responsive to receiving the bill in the second position, pushing the bill by the push bar in the second position towards a second push plate away from the first opening/closing plate in a horizontal direction to store the bill in the second storage part of the main body; and returning the push bar to the initial position responsive to storing the bill in the first or the second storage part.

6. The bill storage device of claim 1, wherein the first opening/closing plate is configured to increase clearance for the fed bill to move from the first position to the first storage part responsive to movement of the push bar towards the first push plate, and wherein the second opening/closing plate is configured to increase clearance for the fed bill to move from the second position to the second storage part responsive to movement of the push bar towards the second push plate.

7. The bill storage device of claim 6, wherein the first opening/closing plate and the second opening/closing plate reduce the clearance responsive to the push bar returning to the initial position.

* * * * *